United States Patent [19]

Riparbelli

[11] 4,009,662

[45] Mar. 1, 1977

[54] DISCRIMINATING SENSOR FOR CONTACT FUZING

[75] Inventor: Carlo Riparbelli, San Diego, Calif.

[73] Assignee: The United States of America as represented by the Secretary of the Air Force, Washington, D.C.

[22] Filed: Sept. 29, 1975

[21] Appl. No.: 618,306

[52] U.S. Cl. ..... 102/70.2 R; 102/73 R; 200/61.45 R; 200/61.45 M

[51] Int. Cl.[2] ..... F42C 19/06; H01H 35/02

[58] Field of Search ..... 102/73, 73 A, 70 R, 102/70.2 R; 200/61.45, 61.45 M, 34

[56] References Cited

UNITED STATES PATENTS

| | | | |
|---|---|---|---|
| 2,436,396 | 2/1948 | McCaslin | 102/73 R X |
| 2,898,416 | 8/1959 | Clurman | 200/61.45 M |
| 2,972,026 | 2/1961 | Kendall | 102/70.2 R X |
| 3,685,452 | 8/1972 | Held | 200/61.45 R X |
| 3,733,448 | 5/1973 | Brady | 200/61.45 R |
| 3,778,572 | 12/1973 | Matsui et al. | 200/61.45 M |
| 3,793,498 | 2/1974 | Matsui et al. | 200/61.45 R |

*Primary Examiner*—David H. Brown
*Attorney, Agent, or Firm*—Joseph E. Rusz; George Fine

[57] ABSTRACT

A discriminating sensor for contact fuzing capable of discriminating between vibrations in flight and terminal impact includes one or more mass-spring systems constituting the moving portion of the sensor. Each mass-spring system is provided with controlled damping. The masses restrained by springs are displaced upon terminal impact to close an electric circuit. Each mass-spring system is provided with controlled damping so that the circuit will not be closed under frequently repeated perturbations or vibrations in flight. One form of damping is by one or more permanent magnets so placed that the magnetic force exerted on the moving mass opposes the motion in either direction.

5 Claims, 9 Drawing Figures

DISCRIMINATING SENSOR FOR CONTACT FUZING

STATEMENT OF GOVERNMENT INTEREST

The invention described herein may be manufactured and used by or for the Government for governmental purposes without the payment of any royalty thereon.

BACKGROUND OF THE INVENTION

Some Inter-Continental Ballistic Missiles (ICBM) are equipped with contact fuzes which trigger the detonation of the warhead upon impact against a target or the ground near the target.

In a typical design configuration the vehicle is conical and its front end, referred to as "the plunger", is a solid cone. The plunger is attached at its rear end to the shell constituting the vehicle structure. A contact sensor is normally attached to the rear of the plunger.

Upon terminal impact of the missile, the front end of the plunger generates waves involving strain, stress, and particle velocity. These waves propagate to the back end of the plunger and impose a negative accleration on the sensor causing it to trigger the detonation of the warhead.

Upon terminal impact of the missile the inertia of the sensor mass causes it to move against its spring mount bias, relative to other portions of the sensor. This relative motion, or mass displacement, is used to either open or close an electric circuit for detonating the missile warhead.

The sensor of the present invention is utilized in the circuit closing mode. The mass suspended to a spring undergoes a displacement due to the impact. This closes a "gap" and with that it closes an electric circuit. Upon impact, due to the strain waves propagating backwards along the plunger, the back end of the plunger undergoes a deceleration with respect to the flight velocity V. Due to inertia the mass has a tendency to continue in the same direction with the velocity V. Therefore it undergoes a downward displacement with respect to the casing thus closing the gap and with it an electric circuit.

Premature functioning of contact fuzes during the flight of the missile has been observed and it is attributed to vibrations of aerodynamical origin, such as for instance sudden variations of the shock wave configuration or impact by rain at low altitude so that the fuzing system is already armed. Thus the object of the present invention is to provide a contact fuzing sensor capable of discriminating between vibrations in flight and terminal impact against the target.

It is assumed that the forces imposed on the front end of the missile by aerodynamic perturbations in flight or impact by rain or snow are appreciably smaller than the force imposed by terminal impact. This assumption is valid becuase terminal impact destroys the plunger. If that occured in flight, the missile would be out of service anyway.

It is also known that while the plunger is progressively destroyed by the terminal impact, the deceleration imposed on the backend of the plunger is steadily increasing.

On the contrary, each perturbation in flight may impose a sudden sharp deceleration on the sensor. However, this deceleration will not increase. It may rise as a step but it will subsequently decrease and be damped out.

While each deceleration imposed by perturbations in flight is smaller than the terminal deceleration, a sequence of perturbations imposed on the undamped system may cause the mass to oscillate with an amplitude large enough to close the gap and to trigger the detonation.

The present invention includes a controlled damped massspring system which is the moving part of the sensor. The aim of damping is either to strongly reduce the amplitude of subsequent oscillation or to make the motion aperiodic, so that for each perturbation there will be no subsequent oscillations after the first displacement.

By this means the additive effect of subsequent perturbations in flight is avoided. Then a perturbation in flight is imposed on the plunger, the motion of the sensor's mass due to the previous oscillations is largely reduced by damping. As a consequence, the displacement of the mass is due essentially to the latest perturbation only and therefore it is much less than the deflection under terminal impact.

SUMMARY OF THE INVENTION

A discriminating sensor for contact fuzing is provided to prevent premature functioning of the contact fuze during flight of the missile due to vibrations of aerodynamical origin such as sudden variations of a shock wave configuration or impact by rain or snow. The sensor is of the circuit closing type in which a mass suspended to a spring undergoes a displacement due to an impact and thereby closes a gap and with that it closes an electric circuit. This may be referred to as a mass-spring system in which the moving part of the contact sensor is provided with controlled damping. In one of the embodiments, the damping is provided by one or more magnets so placed that the force exerted by the magnet on the swinging mass opposes the motion in either direction and it is related to velocity. Prevention against accidental opening can be enhanced by introducing two or more links, each of which is a mass-spring system as described before. In this case the damping of each unit is so adjusted that the closing time for each unit will be different. The links are connected electrically in series and so proportioned by adjusting the masses, spring stiffnesses and dampings that the delay times of the various units are different.

DETAILED DESCRIPTION OF THE PREFERRED EMBODIMENTS

Figure 1:
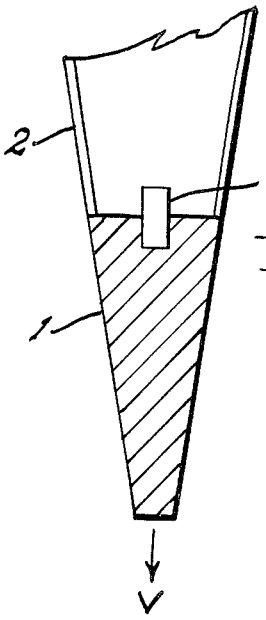
FIG. 1 shows the design configuration of the front end of an ICBM vehicle which is conical.

Now referring to FIG. 1, there is shown the front end design configuration of an ICBM vehicle which is conical. The front end is a solid cone which will be referred to as the plunger. Plunger 1 is attached at its rear end to shell 2 which comprises the vehicle's structure. Contact sensor 3 is attached to the rear end of plunger 1. The direction V of the velocity in flight is indicated.

Figure 2:
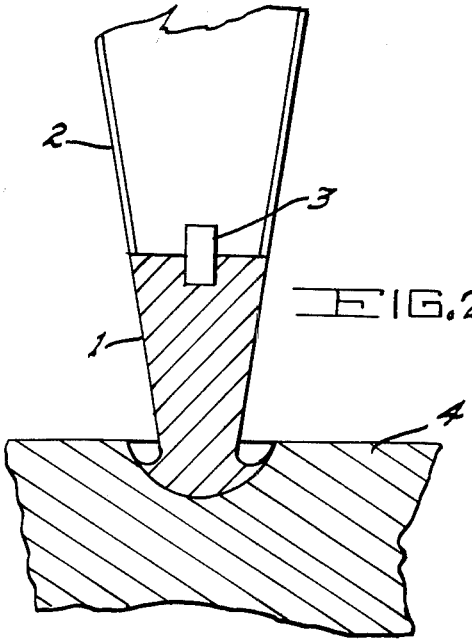
FIG. 2 shows the front end of FIG. 1 upon terminal impact.

Referring to FIG. 2, upon terminal impact of the ICBM missile, the front end of plunger 1 impacts target 4. From the front end of plunger 1 then originates waves involving strain, stress and particle velocity. These waves propagate to the back end of plunger 1 and impose a negative acceleration on sensor 3 causing it to trigger the detonation of the warhead.

Figure 3A:
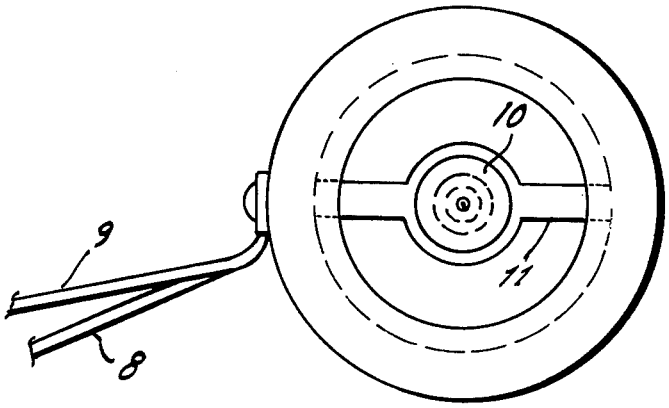
FIG. 3*a* shows a top view of FIG. 3.
Figure 3:
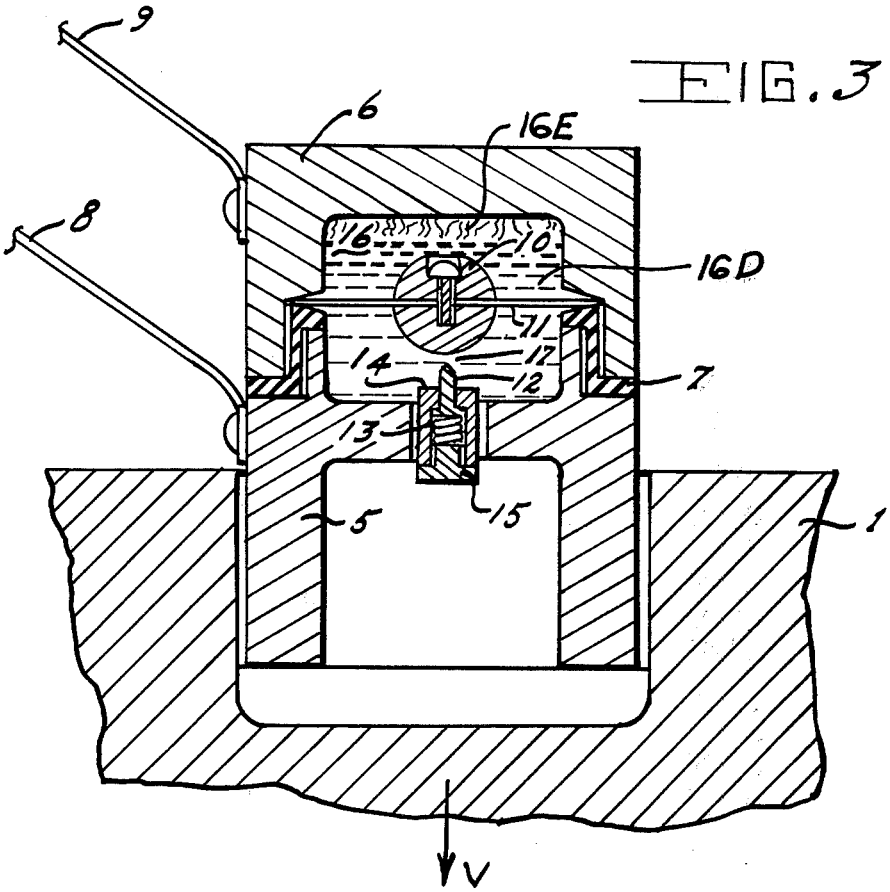
FIG. 3 illustrates a fluid damping sensor and its casing utilized in FIG. 1.

Now referring in detail to FIG. 3, there is shown an example of one type of sensor utilized in FIGS. 1 and 2 in which a mass suspended to a spring undergoes a displacement due to the impact, closes a gap and with it closes an electric circuit. It is noted that FIG. 3*a* illustrates a top view of FIG. 3. A fraction of the back end of plunger 1 is shown with the sensor embedded in it. The sensor casing is comprised of three parts. One part is base 5 which is embedded in plunger 1 and attached to it, made out of metal or of other electrically conductive material. A second part is cover 6, also conductive. A third part is insulating sleeve 7, separating base 5 from cover 6. Electric lead 8 is connected with base 5; another electric lead 9 is connected with cover 6. These leads are connected to the rest of a conventional fuzing circuit (not shown).

Mass 10 is suspended by means of a spring 11 inside the casing and in electric contact with cover 6 through spring 11. Spring 11 is supported at each end by cover 6. In this example, the spring is of the bent leaf type. This may be referred to as the mass-spring system.

Contact probe 12 is inserted in base 5 by means of guide bushing 14. Spring 13 keeps probe 12 in place and its pressure can be adjusted by means of a screw 15. Gap 17 is left between mass 10 and probe 12.

Damping of the mass-spring system may be obtained for instance by filling cavity 16 with a liquid 16*d* having the appropriate density and viscosity. The cavity need not be completely full of liquid. A small fraction can be filled with gas 16*e* (or air) in order to accommodate the thermal expansion of the liquid. It is noted cavity 16 is so constructed as to be sealed to prevent leaking of fluid and gas therefrom.

Upon impact, due to the strain waves propagating backwards along the plunger, the back end of the plunger undergoes a deceleration with respect to the flight velocity V. Due to inertia mass 10 has a tendency to continue in the same direction with the velocity V. Therefore, it undergoes a downward displacement with respect to the casing thus closing gap 17 and with it the electric circuit for the fuze (not shown).

The function of sliding probe 12 in bushing 14 is to allow a longer contact time between mass 10 and probe 12 when the mass swings off its equilibrium position by a displacement large enough to close gap 17. In other words, the sliding probe helps to avoid or delay the mechanical rebound after contact.

Figure 4:
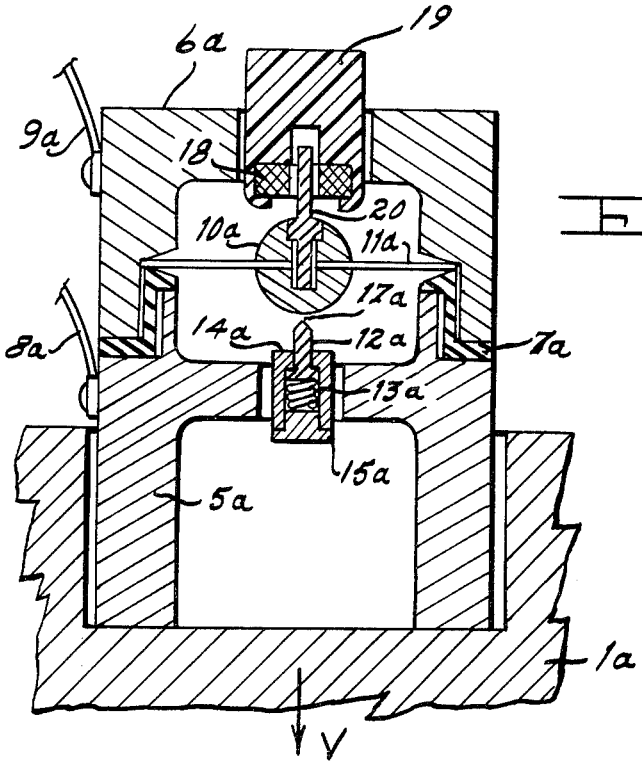
FIG. 4 illustrates the sensor utilizing magnetic damping.
Figure 5:
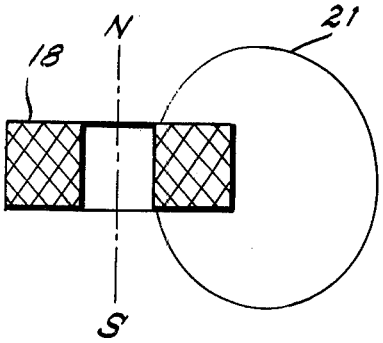
FIG. 5 illustrates the magnet utilized in FIG. 4.

Magnetic damping is shown in FIG, 4. The apparatus of FIG. 4 is identical to that of FIG. 3 except that no fluid is provided in cavity 16 and there has been added the following: permanent magnet 18 which is inserted in cover 6*a* by means of bushing 19 made out of non-magnetic material, for instance a plastic, e.g., vinylite. Ring-shaped magnet 18 isused in this example and it is oriented with its polarities north and south along the axis of the sensor. Magnet 18 is also shown in FIG. 5 in which one of the flux lines 21 is also shown for the sake of illustration for the magnet alone, before it is assembled. After assembly a part of the magnetic field is channeled through pin 20. It does not matter which pole of the magnet is situtated on top and which below.

Pin 20 is rigidly attached to mass 10*a* and therefore moves along with it. Pin 20 is made out of a magnetic material, such as iron, and it is inserted in the opening of ring magnet 18 and it is free to slide in it. Pin 20 is long enough so that the axial resultant force exerted by the magnet on it at rest is approximately zero. When the pin moves inside the magnet's hole, parasite currents are induced in it and the magnetic field opposes the relative motion, thus providing the desired damping.

It is important to notice that the magnet does not provide an initial force which the inertia force on the mass should overcome to initiate the motion.

The function of the magnet herein described is only that of providing damping in the mass-spring system. The force between the magnet and the pin always opposes the relative motion and is an increasing function of the relative velocity.

When the motion of the mass is started by a step displacement due to a flight perturbation and the parameters of the sensor, i.e., mass, spring constant and damping, are known, there may be calculated: the maximum displacement amplitude; the time at which the perturbation is imposed. This time will be indicated as "time delay" of the sensor and it is also important for the design of a multiple sensor as hereinafter described.

Figure 6A:
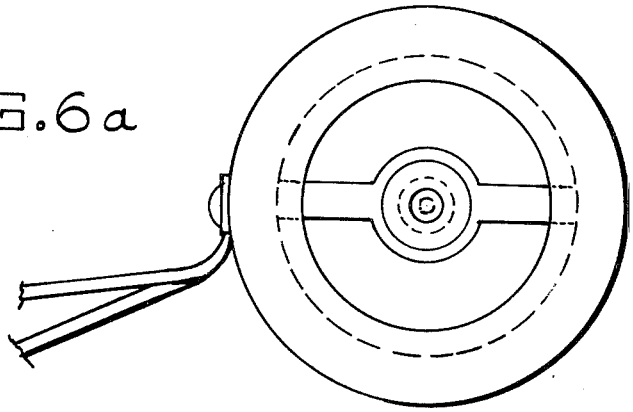
FIG. 6*a* shows a top view of FIG. 6.
Figure 6:
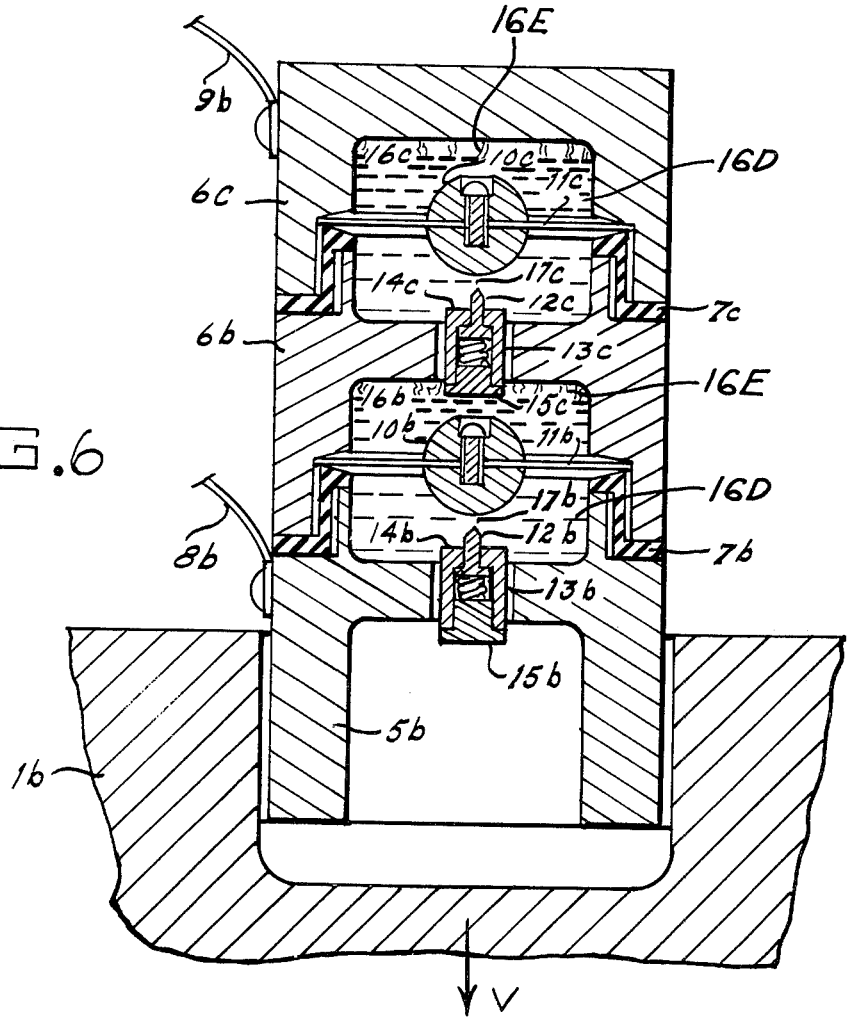
FIG. 6 illustrates a multiple sensor.

An example of the multiple sensor is shown in FIG. 6 in its simplest form, i.e., that of a "dual sensor". This simply consists of two sensors of the type depicted in FIG. 3 electrically joined in series. It is noted that the dual sensor includes base 5*b* and covers 6*b* and 6*c*. Cover 6*b* serves as a cover for base 5*b* and also as a base for cover 6*c*.

Each of the two units has its own mass, spring constant and damping. Thus each unit has its own delay time. The design parameters (mass, spring constant and damping) are so adjusted that the delay times for the two units are different. It follows that this feature provides a greater margin of safety against accidental triggering than a single unit sensor.

The deceleration imposed on the system under terminal impact is much larger and steadily increasing. Therefore in this case both circuits are closed and stay closed. This feature is better guaranteed by the fact that contact pins 12*b* and 12*c* are free to slide, so that the contact, once it is established, lasts for a longer time than it would if mass 10*b* and 10*c* could rebound elastically after impact against pins 12*b* and 12*c*, respectivley.

Any mechanical arrangement of the sensor units is acceptable, provided they are electrically in series.

The assembly shown in FIG. 6 and FIG. 6*a* is based on the unit depicted in FIG. 3 and FIG. 3*a*, respectively, but it would be equally acceptable to base the multiple sensor on the unit with magnetic damping depicted in FIG. 4 or any other variant.

Figure 7:
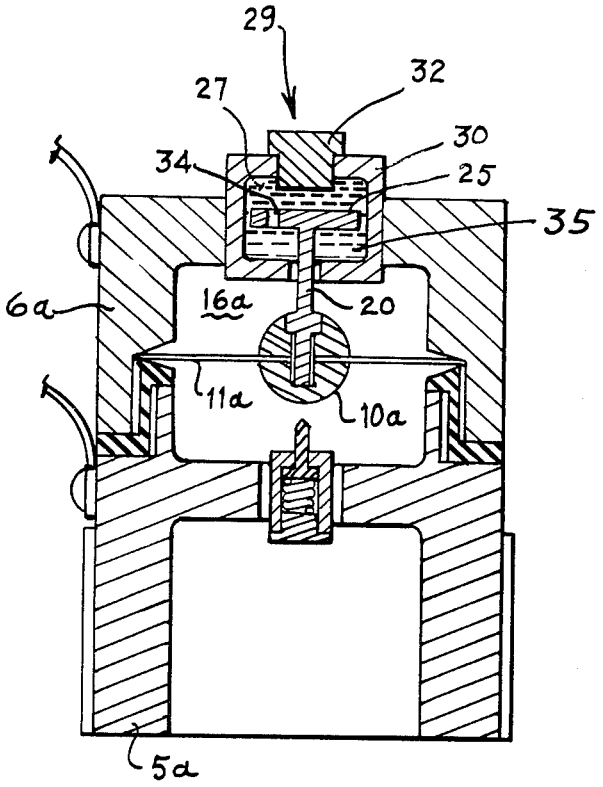
FIG. 7 shows another form of sensor employing a dashpot damper.

The form of sensor in FIG. 7 employs many parts identical in construction and function as employed in the sensor shown at FIG. 3. In the place of or in addition to the damping action of fluid in cavity 16 of FIG. 3, the mass 10*a* (FIG. 7) is connected by rod 20 to piston 25 moving within chamber 27 of dashpot assembly 29. This assembly 29 includes hollow casing 30 attached to sensor cover 6a with chamber 27 being at least partially filled by a fluid 35 admitted through cap 32. The rate of motion and the resulting damping effect of the piston 25 is controlled by the size of orifice 34 through which the fluid must flow from one side to the other of piston 25 when in motion as a result of inertial forces on mass 10*a*.

What is claimed is:

1. A contact fuzing sensor for a missile having a solid cone front end operating as a plunger and attached at its rear end to a shell constituting the vehicle's structure comprising a conducting base forming the rear end of said plunger, said conducting base having a top portion, a conducting cover for said base, said cover having a top portion, a insulating sleeve separating said base from said cover, said cover and insulating sleeve, in combination, forming therein a sealed cavity, first and second external electrical leads for said conducting base and conducting cover, respectively, a first spring having first and second ends and attached electrically at each of said ends to the opposite respective sides of said conducting cover in approximately the center portion of said cavity, a mass attached to and suspended from said first spring at the center portion of said spring, a guide busing in the center of said top portion of said conducting base extending up into said cavity, a slidable contact probe inserted in said guide bushing extending into said cavity, a second spring keeping said probe in place, a screw to adjust the pressure upon said second spring and also to adjust a gap between said probe and said mass; said first spring, said mass, said guide bushing, said slidable probe, said second spring, and said screw, in combination, forming a mass-spring system for said cavity, and means to controllably damp said mass attached to and suspended from said first spring to prevent said gap from closing under frequently occurring perturbations and vibrations in flight of said missile.

2. A contact fuzing sensor as described in claim 1 wherein said damping means is comprised of a fluid of a predetermined density and viscosity substantially filling said cavity.

3. A contact fuzing sensor as described in claim 1 wherein said damping means is comprised of a liquid of predetermined density and viscosity substantially filling said cavity and a gas in said cavity filling the remainder of said cavity in order to accommodate the thermal expansion of said liquid.

4. A contact fuzing sensor as described in claim 1 wherein said damping means is comprised of a second bushing of nonmagentic material positioned in the central top portion of said cover and extending down into said cavity, a permanent ring magnet having a hole therein and inserted in said cavity by way of said second bushing, oriented with its polarities north and south along the axis of said contact fuzing sensor, and a pin of magnetic material such as iron rigidly attached to said mass and moving therewith, said pin being inserted in the opening of said permanent ring magnet and free to slide therein, said pin being long enough so that any axial resultant force exerted by said permanent ring magnet thereupon at rest is approximately zero and upon movement of said pin in said opening parasite currents being induced with the magnetic fields opposing the relative motion providing aforesaid damping.

5. A contact fuzing sensor as described in claim 1 further including a second conducting cover for said conducting cover, said conducting cover serving as a base for said second conducting cover, a second insulating sleeve separating said conducting cover and said second conducting cover, said second insulating sleeve in combination with said conducting cover and said second conducting cover forming therein a second sealed cavity, a second mass-spring system for said second cavity identical to said mass-spring system, said mass-spring system and second mass-spring system being electrically in series, and second means to controllably damp said second mass-spring system.

* * * * *